US006789535B1

(12) United States Patent
McIntyre

(10) Patent No.: US 6,789,535 B1
(45) Date of Patent: Sep. 14, 2004

(54) ROLLER ARROW REST

(76) Inventor: David J. McIntyre, 963 Rte. 104A, Sterling, NY (US) 13156

( * ) Notice: Subject to any disclaimer, the term of this patent is extended or adjusted under 35 U.S.C. 154(b) by 0 days.

(21) Appl. No.: 10/659,984

(22) Filed: Sep. 11, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | | |
|---|---|---|---|---|---|
| 4,791,907 | A | | 12/1988 | Corley | 124/41 |
| 5,031,601 | A | * | 7/1991 | Gunter | 124/44.5 |
| 5,117,803 | A | * | 6/1992 | Johnson | 124/44.5 |
| 5,261,383 | A | * | 11/1993 | Halamay | 124/44.5 |
| 5,383,441 | A | * | 1/1995 | Lightcap, Jr. | 124/44.5 |
| 5,419,303 | A | * | 5/1995 | Stewart | 124/44.5 |
| 5,960,779 | A | * | 10/1999 | Jessee et al. | 124/44.5 |
| 6,202,635 | B1 | * | 3/2001 | Evans | 124/44.5 |
| 6,561,175 | B1 | | 5/2003 | Tidmore | 124/44.5 |

* cited by examiner

*Primary Examiner*—John A. Ricci
(74) *Attorney, Agent, or Firm*—Bernhard P. Molldrem, Jr.

(57) ABSTRACT

An arrow rest for an archery bow has multiple low-friction rollers that are disposed on respective sides of the arrow shaft. A mounting slide is adjustably attached onto the riser of the bow; a block portion is formed on a proximal end of the mounting slide; and a rest portion is adjustably mounted on the block portion. A dovetail slide arrangement permits left-to-right center shot adjustment of the rest portion in respect to the bow riser. First and second guide rollers are positioned on upper and lower arms disposed in a transverse support plane. The first and second guide rollers are displaceable over a limited axial distance within the support plane but only in a direction perpendicular to a radius from the arrow shaft, and are not displaceable in a direction radial to the axis of the arrow shaft. A third guide roller is incorporated into a burger button mechanism, with spring action to hold the associated third guide roller in contact with the arrow shaft.

11 Claims, 3 Drawing Sheets

ROLLER ARROW REST

BACKGROUND OF THE INVENTION

This invention relates to archery equipment and accessories, and is more particularly concerned with an arrow rest device that is mounted on the bow to support an arrow prior to and during release. The invention is more particularly directed to a multiple roller type arrow rest in which the rollers support shaft of the arrow on three sides.

There are many arrow rests now being employed both for hunting and for target archery. These arrow rests serve the purpose of holding the shaft of the arrow at a well-defined position on the riser of the bow when the archer is aiming and also when he or she releases the bow to shoot the arrow at the target. Typically, these are wire or shelf type devices, which have sliding or frictional contact with the arrow. An improved type of arrow rest employs lightweight, low resistance rollers to support the shaft of the arrow. A single roller version of an arrow rest, intended especially for bow fishing, is shown generally in U.S. Pat. No. 4,791,907, in which a single roller is mounted directly onto the riser within the window area. A multiple roller arrow rest is shown in U.S. Pat. No. 6,561,175, where two guide rollers are situated on a horizontal base member below the arrow shaft, and a third guide roller is mounted on a swing-up hinged member above the arrow shaft. The three guide rollers have axes that intersect one another in a common plane, and there is a space formed between the three rollers that is adapted to accommodate the arrow shaft.

These arrow rests of the prior art do not have any provision for right-to-left adjustment, with respect to the bow riser, and thus are difficult to center on target. In addition, these prior arrow rests do not take into account the fact that the bowstring, when released, moves in a somewhat sinusoidal path and does not move the nock end of the arrow in a straight line towards the target. Consequently, these prior art bow sights do not adequately compensate for any side to side movement of the bowstring and arrow, and cannot ensure a narrow pattern of arrows on the target. In addition, prior roller-type arrow rests have employed rollers with concave contact surfaces. As the rollers will have different diameters at different places, some part of the roller will be moving either faster or slower than the arrow shaft, and this can produce either undesirable noise or inconsistency in placement of the arrows into the target.

OBJECTS AND SUMMARY OF THE INVENTION

It is an object of the present invention to provide a multiple roller arrow rest that avoids the drawbacks of the prior art, and which helps the archer achieve consistency and accuracy.

It is another object to provide an arrow rest that is consistent and quiet in operation, and is simple to employ.

It is a further object to provide an arrow rest that holds the arrow in place securely on the bow until the archer is ready to release or shoot the arrow.

According to an aspect of this invention, a multiple-roller arrow rest is provided for an archery bow with the arrow rest being adapted for supporting the shaft of an arrow at a support plane that is at a fixed location with respect to the riser or the bow, and with the arrow having a horizontal axis and the support plane being perpendicular to the arrow shaft axis. The arrow rest assembly includes a mounting slide portion that is adjustably attached onto one side of the riser or the other, depending on whether the archer is right or left handed; a block portion attached onto the mounting slide portion; and a rest portion that is adjustably mounted on the block portion. Preferably there is a dovetail slide arrangement that permits left-to-right center shot adjustment of the rest portion in respect to the bow riser. The dovetail arrangement can take the form of a transverse rail in one of the block portion and the rest portion and a mating transverse channel formed in the other. These slide transversely, but not up and down, nor front to back. There can be a threaded cutout being formed in a surface of one of the rail and channel, and an adjustment screw supported in a mating surface of the other. The adjustment screw can be turned to slide the rest portion relative to the block portion. There can also be a horizontal cut through the block portion, and a set screw passing through the block portion across said horizontal cut. This feature can tighten the transverse channel and transverse rail of the dovetail arrangement against one another to lock the adjustment mechanism in place.

In implementations of the arrow rest of this invention, there are first, second and third guide rollers positioned for supporting the arrow shaft on three sides at the support plane. Upper and lower arms are supported from a main portion of this rest portion, and are also disposed in the support plane, each arm having a channel, e.g., a bore, extending along the axis of the arm. First and second support shafts each coaxially mount a respective one of the first and second guide rollers, that is, the support shafts each extend through the axis of the associated guide roller. The support shafts are slidably supported in the channels or bores of the respective upper and lower arms. In this arrangement, the first and second guide rollers are displaceable over a limited axial distance within the support plane but can move only in a direction perpendicular to a radius from the arrow shaft, and are not displaceable in a direction radial to the axis of the arrow shaft. Coil springs are situated over the respective support shafts between the associated first and second guide rollers and outer ends of the associated upper and lower arms. This arrangement permits the guide rollers to move out of the way when an arrow is being inserted into the arrow rest, and then snap back into position when the arrow is in place.

A burger button mechanism is situated on the main portion of the rest portion and the third guide roller is supported here with spring action to hold the associated third guide roller in contact with the arrow shaft.

In a preferred arrangement, the burger button mechanism includes a threaded tube fitting into a mating threaded bore in the main portion of the rest portion, a threaded shaft passing slidably through the threaded tube, a spring disposed in an annulus defined between the tube and the threaded shaft, a nut fitting onto an outer end of the threaded shaft, and a carriage that holds the third guide roller and which is mounted at an opposite, inner end of the threaded shaft.

Also, in preferred arrangements, the upper and lower arms are oriented at substantially a right angle to one another. The rest portion has upper and lower leg members that extend generally upward and downward, respectively, i.e., at about a 45 degree angle, from the main portion of said rest portion, and the upper and lower arms are formed at outer ends of the upper and lower leg members, respectively, and at substantially a right angle thereto. The leg members define vane passageways between the first and third guide rollers and between the second and third guide rollers, for permitting vanes or fletchings at the nock end of the arrow to pass through.

Preferably, the mounting slide portion is sufficiently elongated in a fore-and-aft direction that the rest portion is positioned proximally of the riser of the bow. The mounting slide portion and said block portion can be unitarily formed.

The above and many other objects, features, and advantages of the invention will become apparent from the ensuing description of a preferred embodiment, which should be read in conjunction with the accompanying Drawing.

DETAILED DESCRIPTION OF THE PREFERRED EMBODIMENT

Figure 1:
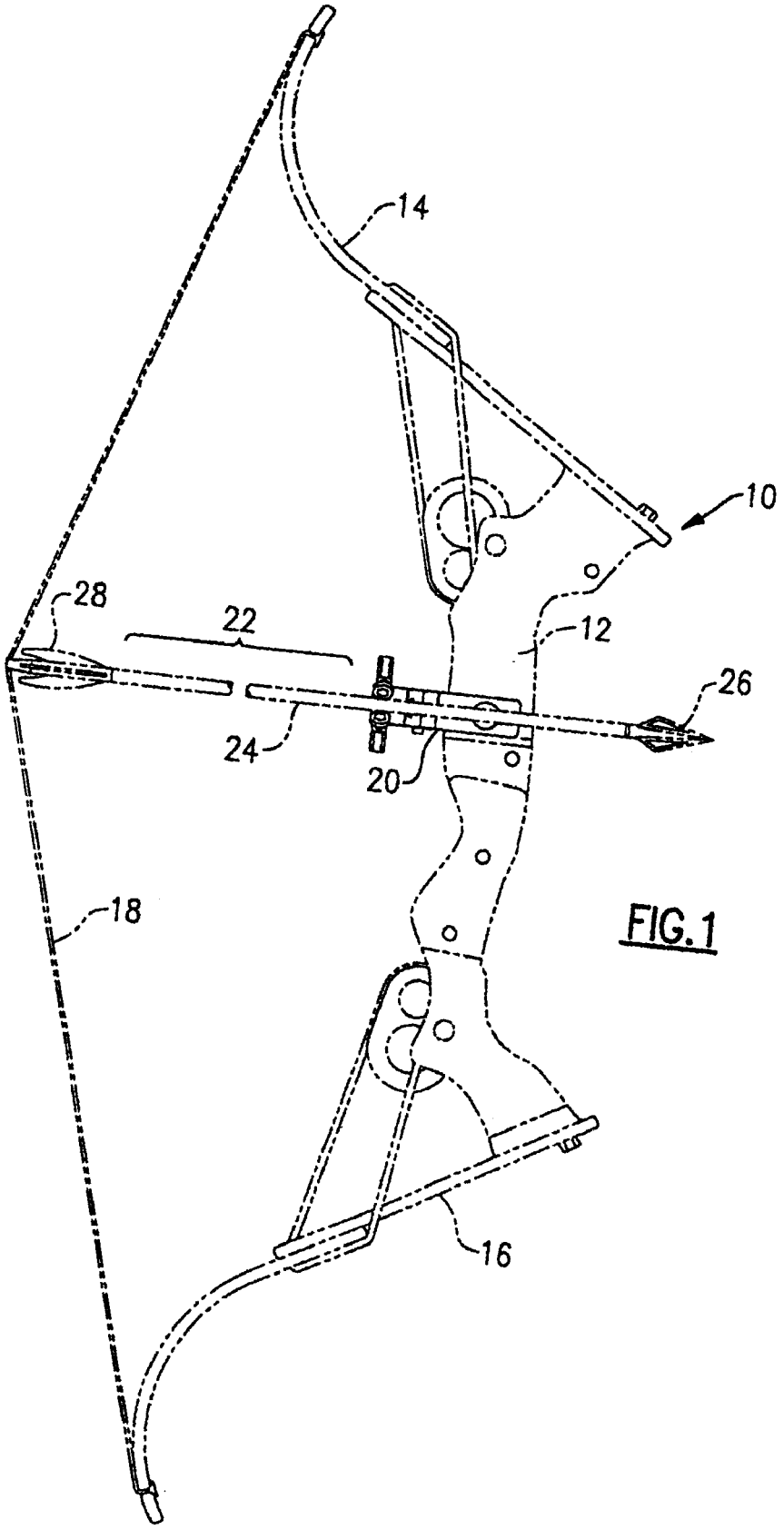
FIG. 1 is a side elevation showing a typical bow with the arrow rest of this invention installed on its riser.
Figure 2:
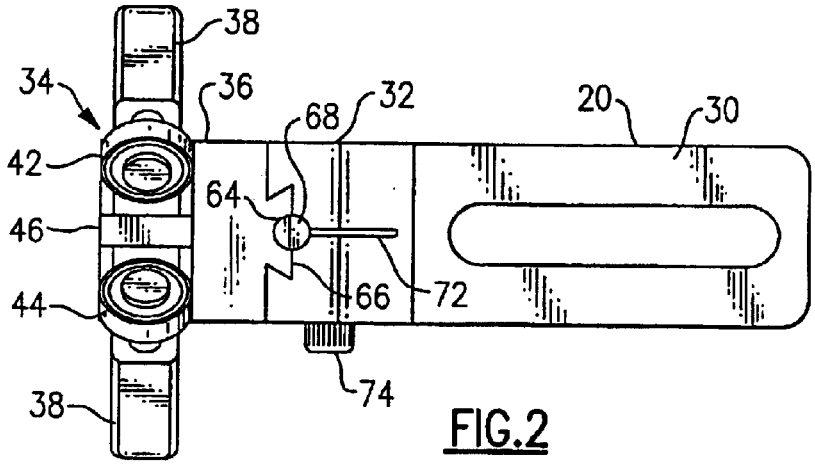
FIG. 2 is a side elevation of the arrow rest according to an embodiment of this invention.
Figure 3:
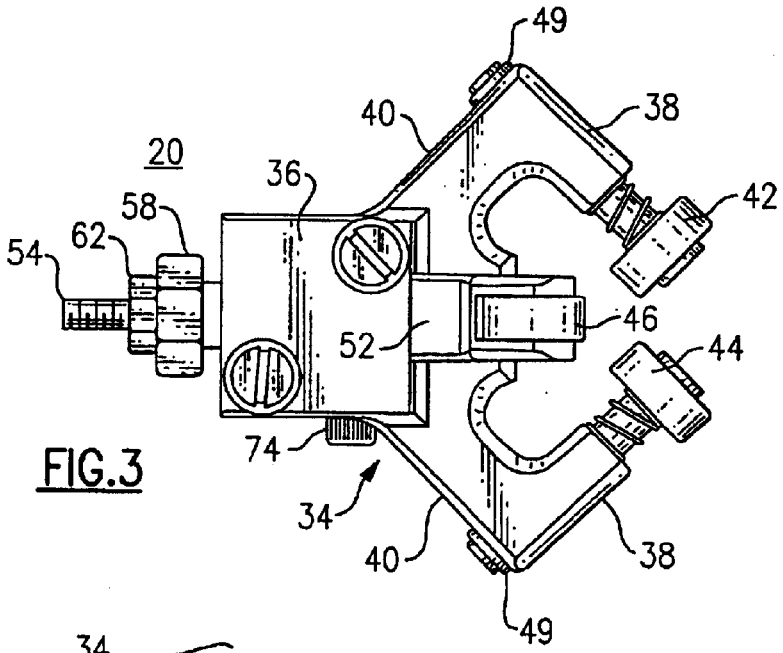
FIG. 3 is a front elevation of the arrow rest of this embodiment.
Figure 4:
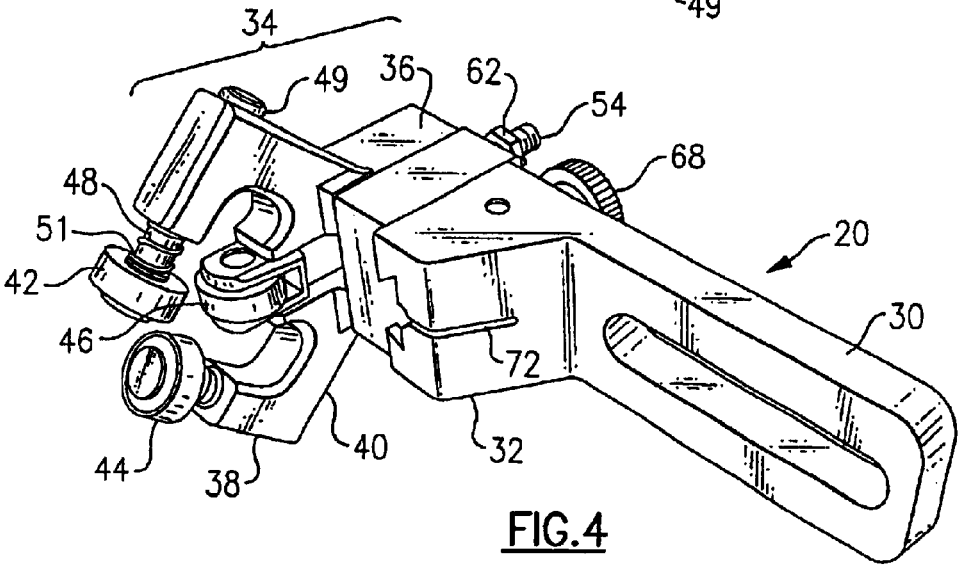
FIG. 4 is a perspective view of the arrow rest of this embodiment.
Figure 5:
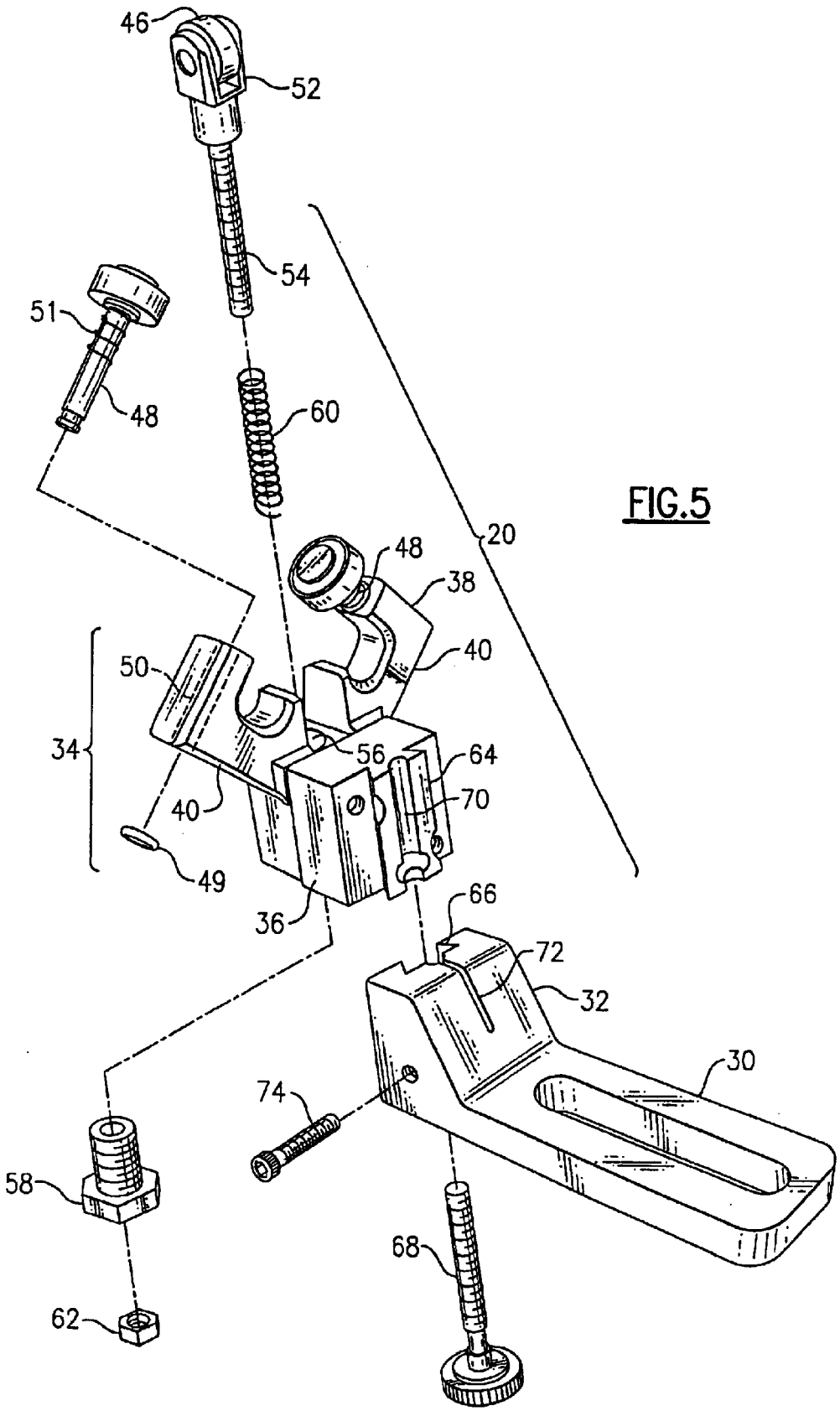
FIG. 5 is an exploded assembly view of the arrow rest of this embodiment.

With reference now to the Drawing, and initially to FIG. 1, an archery bow 10 illustrates the environment in which this invention is employed. Here, the bow 10 has a riser 12 or middle section, an upper limb 14, lower limb 16, and a bowstring 18 connected between the tip portions of the limbs 14 and 16. An arrow rest 20 according to an embodiment of this invention is mounted onto the bow riser 12 in a window portion thereof, i.e., just above the handle portion.

Here, the bow 10 is adapted for left-hand shooting, with the arrow rest 20 disposed on the right side of the bow riser. However, for right-hand shooting, the arrow rest 20 would be attached, in mirror-image fashion, onto the other side of the riser.

An arrow 22 is shown here supported in the arrow rest. The arrow has an elongated shaft 24, a head 26 at its distal end, and vanes 28, i.e., fletchings or feathers, at its proximal end, which has the usual nock or notch that is placed onto the bowstring 18. The shaft 24 of the arrow is held in among the several rollers of the arrow rest, which will be described just below.

As shown in more detail in FIGS. 2 to 5, the arrow rest 20 has a mounting slide 30 that mounts onto a fitting on the riser 12, and extends proximally therefrom, i.e., towards the archer. A block portion 32 of the arrow rest is here integrally formed with the mounting slide 30, and a rest portion 34 is slidably mounted onto the block portion 32, with a provision for adjusting the left-to-right position of the rest portion 34 relative to the bow riser.

The rest portion 34 has a main, generally rectangular portion 36 and guide arms 38 that are attached by means of upper and lower support legs 40 to the main portion 36. The upper and lower support legs 40 project upward and downward, respectively, at about forty-five degrees from the main portion in a plane that is perpendicular to the axis of the arrow shaft 24 held in the arrow rest. Then the upper and lower guide arms 38 project downward and upward, respectively, from the ends of the support legs in the same plane. There is a gap between the ends of the guide arms, and first and second guide rollers 42 and 44 are positioned here at ends of the upper and lower arms, respectively. A third guide roller 46 is positioned opposite this gap on the main portion 46 of this rest portion 44.

In this embodiment, the guide rollers 42, 44, and 46 are light-weight, low-friction rollers, and have generally cylindrical contact surfaces, unlike the concave rollers that have been employed in roller type arrow rests of the prior art. These rollers produce more reliable, quieter performance.

There are support posts 48 that mount the first and second guide rollers 42, 44 in the upper and lower guide arms 38. The posts 48 are slidably mounted in bores or channels 50 that extend lengthwise through the respective arms, and are permitted at least a limited amount of travel in that lengthwise direction. The respective guide rollers 42, 44 are mounted on their axes on the posts 48. Each post has an elastic ring 49 in an annular recess on the end opposite the guide roller, with the ring 49 holding the post in place in the guide arm. A small compression spring 51 is disposed on each post 48 between the end of the respective guide arm 38 and the associated guide roller 42, 44, to bias the two guide rollers yieldably towards one another. These rollers thus can be deflected to the side to allow the arrow shaft to be inserted into place.

The third guide roller 46 is supported opposite the first and second guide rollers on a burger button assembly, which is here formed of a carriage 52 for the roller 46, and a threaded post 54 that passes through a transverse bore or channel 56 in the main portion 36. A threaded nipple 58 is situated in the opposite end of the bore or channel 56 (obscured in FIG. 5). A compression spring 60 extends over the threaded post 54 and fits into an annulus that is defined between the post 54 and the wall of the bore or channel 56, and is compressed between the carriage 52 and a facing end of the nipple 58. The nipple 58 is rotated to adjust the position of the carriage 52 and roller 46. A tension adjustment nut 62 is located on the end of the post 54 opposite the carriage 52, which end projects through an opening in the nipple 58. This nut 62 can be rotated to adjust the spring compression on spring 60 for the third roller 46.

Lateral shot adjustment is achieved by means of a screw actuated dovetail slide mechanism, including a dovetail shaped rib 64 formed on the main portion of the rest portion 34, and a mating dovetail shaped channel 66 formed in a corresponding surface of the block portion 32. These are oriented with their axes in the horizontal, or side-to-side direction. A transverse aperture 70 is formed in this mechanism, with a threaded half in the block portion 32 and an unthreaded portion in a mating surface of the dovetail rib 64 in the rest portion. A threaded adjustment screw 68, with a finger wheel at one end, is situated in this aperture, and engages the threads on the one side, so that when the finger wheel is rotated one way or the other the rest portion 34 moves to the right or to the left. There is a cut-through 72 formed across the block portion 32 in the horizontal direction, i.e., the direction of the rib 64 and channel 66. A set screw 74 is situated in a threaded bore that crosses the cut-through 72, and this set screw 74 can be tightened to lock the left-to-right position of the arrow rest portion 34 when a suitable adjustment has been made.

While the invention has been described in detail with respect to a preferred embodiment, it should be recognized that the invention is not limited to that one precise embodiment. Rather, many modifications and variations would present themselves to persons skilled in the art without departing from the scope and spirit of the invention, as defined in the appended claims.

I claim:

1. A multiple-roller arrow rest for an archery bow, said bow having a riser, upper and lower limbs, and a bowstring supported between end portions of said limbs; the arrow rest being adapted for supporting a shaft of an arrow at a support plane fixed with respect to said riser and perpendicular to an axis of said arrow shaft; the bow rest comprising:

a mounting portion attached onto one side of said riser;

a block portion attached onto said mounting portion;

a rest portion that is adjustably mounted on said block portion, including dovetail means permitting left-to-right center shot adjustment of the rest portion in respect to the bow riser;

said rest portion including:

first, second and third guide rollers positioned for supporting the arrow shaft on three sides thereof at said support plane;

upper and lower arms supported on a main portion of said rest portion, and disposed in said support plane, each arm having a channel therein;

first and second support shafts each coaxially mounting a respective one of said first and second guide rollers and being slidably supported in the channel of a respective one of said upper and lower arms such that the first and second guide rollers are displaceable over a limited distance within said support plane but are not displaceable in a direction radial to the axis of the arrow shaft; and a burger button arrangement situated on the main portion of the rest portion and resiliently supporting said third guide roller for holding same against said arrow shaft, the burger button member including a threaded nipple adjustably fitting into a mating threaded bore in the main portion of said rest portion, a threaded shaft passing through said threaded nipple, a spring disposed in an annulus defined between said nipple and said threaded shaft, a nut fitting onto an end of said threaded shaft, and a carriage holding said third guide roller and mounted at an opposite end of said threaded shaft, said nipple and said nut both being rotatable to adjust both the position of the third guide roller and the spring tension applied by said spring between said nipple and said carriage.

2. The arrow rest according to claim 1 wherein said upper and lower arms are oriented at substantially a right angle to one another.

3. The arrow rest according to claim 1 wherein said rest portion has upper and lower leg members that extend generally upward and downward, respectively, from the main portion of said rest portion, and said upper and lower arms are formed at outer ends of said upper and lower leg members, respectively, and at substantially a right angle thereto.

4. The arrow rest according to claim 3 wherein said leg members define vane passageways between said first and third guide rollers and between said second and third guide rollers, for permitting vanes of said arrow to pass therethrough.

5. The arrow rest according to claim 1 wherein said rest portion further includes first and second coil springs situated over said first and second support shafts, respectively between the associated first and second guide rollers and outer ends of the associated upper and lower arms for biasing said support shafts outwards without interfering with rotation of the associated guide rollers.

6. The arrow rest according to claim 1 wherein said mounting portion is sufficiently elongated in a fore-and-aft direction that the rest portion is positioned proximally of the riser of the bow.

7. The arrow rest according to claim 1 wherein said mounting portion and said block portion are unitarily formed.

8. The arrow rest according to claim 1, wherein said first, second, and third guide rollers are light-weight, low friction rollers and have generally cylindrical contact surfaces.

9. A multiple-roller arrow rest for an archery bow, said bow having a riser, upper and lower limbs, and a bowstring supported between end portions of said limbs; the arrow rest being adapted for supporting a shaft of an arrow at a support plane fixed with respect to said riser and perpendicular to an axis of said arrow shaft; the bow rest comprising:

a mounting portion attached onto one side of said riser;

a block portion attached onto said mounting portion;

a rest portion that is adjustable mounted on said block portion, including dovetail means permitting left-to-right center shot adjustment of the rest portion in respect to the bow riser;

said rest portion including:

first, second and third guide rollers positioned for supporting the arrow shaft on three sides thereof at said support plane;

upper and lower arms supported on a main portion of said rest portion, and disposed in said support plane, each arm having a channel therein;

first and second support shafts each coaxially mounting a respective one of said first and second guide rollers and being slidably supported in the channel of a respective one of said upper and lower arms such that the first and second guide rollers are displaceable over a limited distance within said support plane but are not displaceable in a direction radial to the axis of the arrow shaft; and a burger button arrangement situated on the main portion of the rest portion and resiliently supporting said third guide roller for holding same against said arrow shaft, wherein said dovetail means includes a transverse rail in one of said block portion and said rest portion, a mating transverse channel formed in the other of said block portion and said rail portion, a threaded cutout being formed in one surface of one of said rail and said channel, and an adjustment screw being supported in a mating surface of the other of said rail and said channel, said adjustment screw being rotatable to slide the rest portion relative to said block portion, and having a portion extending laterally beyond said transverse rail and said transverse channel, and a finger wheel on said laterally extending portion to permit left-to-right center shot adjustment in the field.

10. The arrow rest according to claim 9 wherein said block portion has a horizontal cut therethrough, and a set screw passing through the block portion across said horizontal cut but not contacting said adjustment screw, for causing the transverse channel and transverse rail of said dovetail means to squeeze against one another to lock the same in place.

11. A multiple-roller arrow rest for an archery bow, said bow having a riser, upper and lower limbs, and a bowstring supported between end portions of said limbs; the arrow rest being adapted for supporting a shaft of an arrow at a support plane fixed with respect to said riser and perpendicular to an axis of said arrow shaft; the bow rest comprising:

a mounting portion attached onto one side of said riser;

a block portion attached onto said mounting portion;

a rest portion that is adjustably mounted on said block portion, including dovetail means permitting left-to-right center shot adjustment of the rest portion in respect to the bow riser;

said rest portion including:

first, second and third guide rollers positioned for supporting the arrow shaft on three sides thereof at said support plane;

upper and lower arms supported on a main portion of said rest portion, and disposed in said support plane, each arm having a channel therein;

first and second support shafts each coaxially mounting a respective one of said first and second guide rollers and being slidably supported in the channel of a respective one of said upper and lower arms such that the first and second guide rollers are displaceable over a limited distance within said support plane but are not displaceable in a direction radial to the axis of the arrow shaft; and a burger button arrangement situated on the main portion of the rest portion and resiliently supporting said third guide roller for holding same against said arrow shaft, wherein said first, second, and third guide rollers are light-weight, low friction rollers and have generally cylindrical contact surfaces.

* * * * *